US005283977A

United States Patent [19]

Smith

[11] Patent Number: 5,283,977

[45] Date of Patent: Feb. 8, 1994

[54] REVERSIBLE DOOR FRAME THRESHOLD

[75] Inventor: Rick Smith, Pittsburg, Kans.

[73] Assignee: Castlegate, Inc., Pittsburg, Kans.

[21] Appl. No.: 964,302

[22] Filed: Oct. 21, 1992

[51] Int. Cl.[5] ..... E06B 1/70

[52] U.S. Cl. ..... 49/380; 49/467; 49/470

[58] Field of Search ..... 49/380, 467, 468, 469, 49/470, 471, 382; 52/738, 730.2; 403/4, 363

[56] References Cited

U.S. PATENT DOCUMENTS

| | | | |
|---|---|---|---|
| 4,055,917 | 1/1977 | Coller | 49/469 |
| 4,214,406 | 7/1980 | Chupik | 49/382 |
| 4,305,229 | 12/1981 | Naylor | 49/380 |
| 4,310,991 | 1/1982 | Seely | 49/470 |
| 4,411,104 | 10/1983 | St. Aubin | 49/467 |
| 4,441,277 | 4/1984 | Naylor | 49/380 |
| 4,527,303 | 7/1985 | Civitelli | 403/4 |
| 4,956,940 | 9/1990 | Touton, III | 49/467 |

*Primary Examiner*—Peter M. Cuomo
*Assistant Examiner*—Darnell M. Boucher
*Attorney, Agent, or Firm*—Shook, Hardy & Bacon

[57] ABSTRACT

A reversible threshold is provided for positioning beneath a door mounted in a door frame. The threshold includes a base and a riser which is removably connected to the base and provides a sealing surface for the bottom edge of the door. The riser has a sloped upper surface to carry water away from the door. The base can be placed in one orientation for an in-swing door mounting and another position for an out-swing door mounting. The riser is also reversible so that it can be placed with the top surface sloping away from the door when the base is in either orientation.

20 Claims, 2 Drawing Sheets

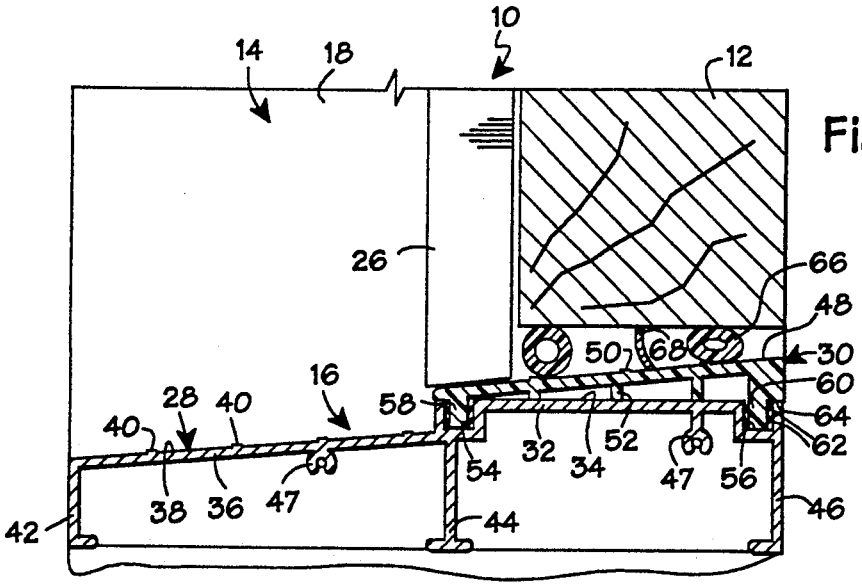
Fig. 3.
Fig. 4.
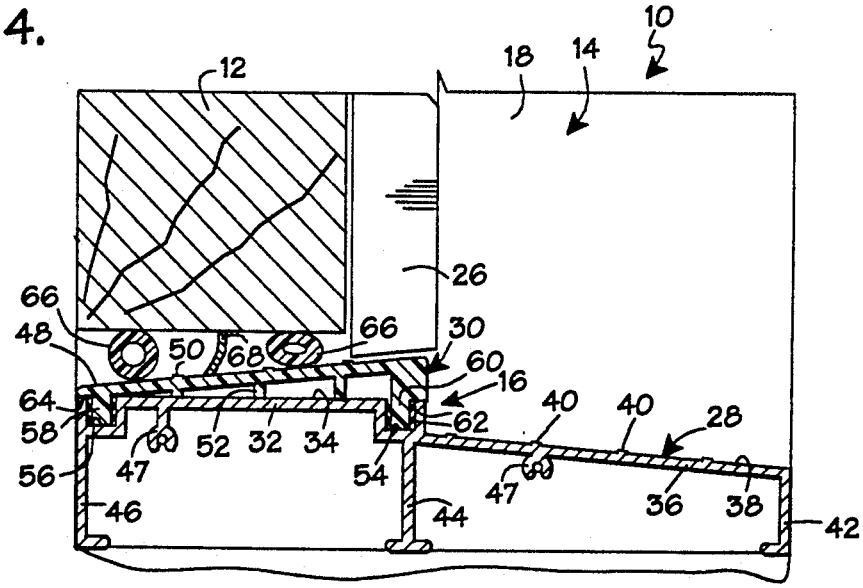
Fig. 5.
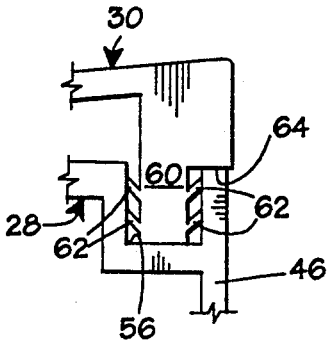

REVERSIBLE DOOR FRAME THRESHOLD

BACKGROUND OF THE INVENTION

This invention relates in general to door frames and, more particularly, to a threshold for such frames.

Various types of thresholds are available for use in a door frame to provide a seal which prevents air and water infiltration between the threshold and the bottom of the door. The threshold, particularly when used in conjunction with an exterior door of a building, may also include a base portion which slopes away from the door to carry water away from the door and prevent it from seeping under the door and into the building.

Many types of door frames are designed so that the door can be mounted to open into the building or the door can be reversed and mounted so that it swings out of the building. A door which opens inwardly is commonly referred to as an "in-swing" door while a door that opens outwardly is referred to as an "out-swing" door. A door frame which allows for reversible mounting of the door is highly desirable because it reduces the number of different door frames that need to be stocked by manufacturers and suppliers.

One problem that complicates the switching of a door frame between in-swing and out-swing configurations is that many types of conventional thresholds are not interchangeable and can be used only with an in-swing or an out-swing door. A builder utilizing a reversible door frame must then separately order the correct type of threshold for the particular application. This reduces the versatility of the door frame and the ability to adapt the door frame to the desired configuration at the job site. In order to more fully benefit from the advantages provided by a reversible door frame, a need has thus developed for a threshold that can be easily adapted for use with both in-swing and out-swing door configurations.

SUMMARY OF THE INVENTION

It is an object of this invention to provide a door frame threshold which can be easily converted for use with both in-swing and out-swing door configurations so that the door frame can be readily modified at the job site to provide the desired door opening configuration.

It is also an object of this invention to provide a door frame threshold which is reversible between in-swing and out-swing configurations but also contains an upper surface which slopes away from the interior of the building in either configuration so that water is prevented from seeping or being blown into the building.

To accomplish these and other related objects of the invention, in one aspect the invention encompasses a threshold comprising a base, a riser coupled with the base and having a top surface which extends in a plane at an angle to a horizontal plane, and interlocking members carried by the base and the riser for removably connecting the riser to the base and allowing the riser to be moved between a first position with the top surface of the riser tilted in one direction in relation to the base and a second position with the top surface tilted in an opposite direction in relation to the base.

In another aspect, the invention encompasses a door frame assembly comprising:

a hinge jamb;

a strike jamb spaced from the hinge jamb to provide a doorway opening;

a head connecting upper portions of the hinge jamb and the strike jamb;

a threshold extending between lower portions of the hinge jamb and the strike jamb, said threshold comprising a base, a riser coupled with the base and having a top surface which extends in a plane at an angle to a horizontal plane, and interlocking members carried by the base and the riser for removably connecting the riser to the base and allowing the riser to be moved between a first position with the top surface of the riser tilted in one direction in relation to the base and a second position with the top surface tilted in an opposite direction in relation to the base.

BRIEF DESCRIPTION OF THE DRAWINGS

In the accompanying drawings which form a part of the specification and are to be read in conjunction therewith and in which like reference numerals are used to indicate like parts in the various views:

FIG. 3 is an end elevational view of the door assembly taken in vertical section with the threshold and door mounted in an in-swing configuration;

FIG. 4 is an end elevational view of the door assembly taken in vertical section with the threshold and door mounted in an out-swing configuration; and FIG. 5 is an enlarged fragmentary end elevational view of interlocking portions of the threshold riser and base.

DESCRIPTION OF THE PREFERRED EMBODIMENT

Figure 1:
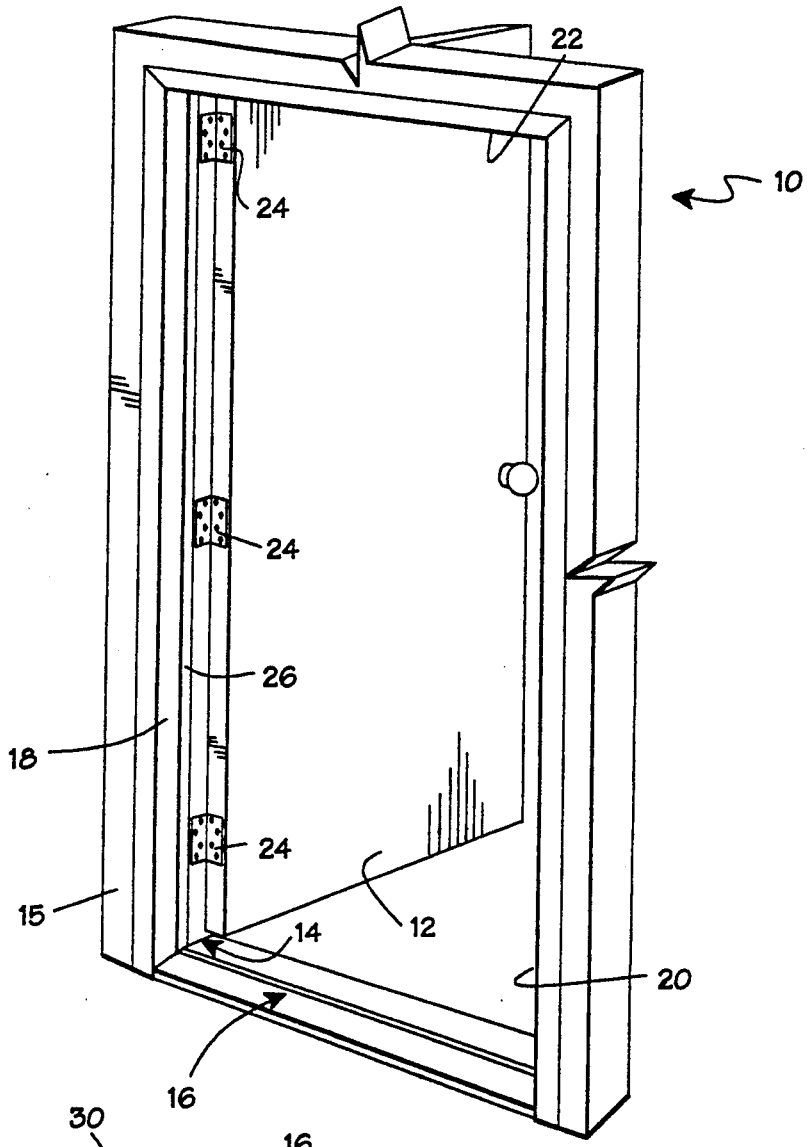
FIG. 1 is a fragmentary perspective view of a door assembly which includes a reversible threshold of a type in accordance with the present invention.

Referring now to the drawings in greater detail and initially to FIG. 1, a door assembly in accordance with the present invention is represented broadly by the numeral 10 and includes a door 12 mounted on a frame 14. The frame 14 is installed in a wall 15 of a building and includes a threshold 16 which extends horizontally between vertically oriented hinge and strike jambs 18 and 20, respectively. A head 22 joins the upper portions of the hinge jamb 18 and strike jamb 20.

The door 12 is mounted on the hinge jamb 18 by suitable hinges 24 and, depending upon the orientation of the frame 14, can open either into the building in an in-swing configuration or out of the building in an out-swing configuration. As illustrated in FIG. 1, the door 12 is mounted in an in-swing configuration. When door 12 is closed, the sides and top of the door 12 seal against weatherstripping 26 provided on the jambs 18 and 20 and the head 20 and the bottom of the door 12 seals against the threshold 16.

Figure 2:
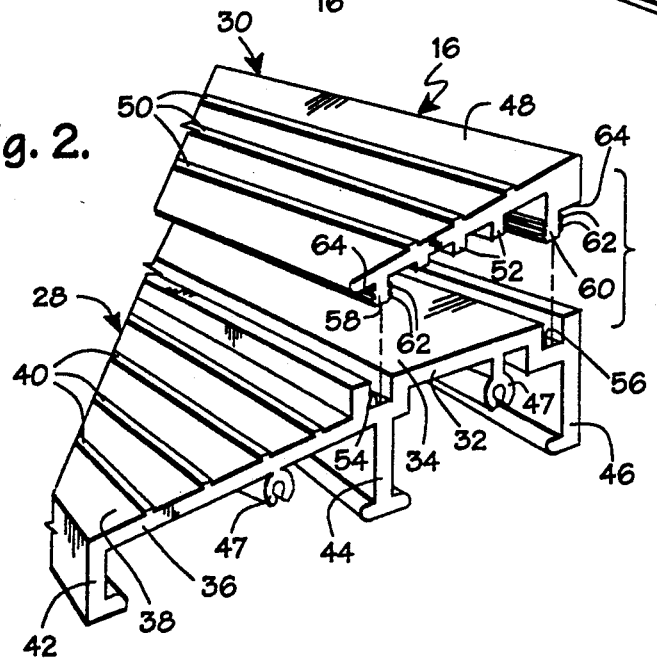
FIG. 2 is an exploded end perspective view of the threshold shown in fragment.

Turning additionally to FIG. 2, the threshold 16 comprises a base 28 and a resilient riser 30 which can be removably connected to the base 28. The base 28 is preferably formed from a rigid, durable material such as aluminum or another metal, although various other materials such as various polymers can be used instead. The base 28 has a longitudinal length sufficient to extend completely between the hinge jamb 18 and strike jamb 20 and preferably has a width sufficient to extend completely from the front to the back edge of the jambs 18 and 20. A first portion 32 of the base 28 underlies the removable riser 30 and presents a substantially flat, horizontally extending upper surface 34. A second portion 36 of the base 28 extends from first portion 32 and has an upper surface 38 which is inclined at an angle so that it slopes away from the first portion 32. A series of spaced apart, parallel ribs 40 are provided on the upper surface 38 of the base second portion 36 for traction purposes. Alternatively, various types of non-skid materials may be applied to the upper surface to prevent an individual from slipping on the upper surface 38, particularly when it is wet.

The base 28 is supported on three longitudinally extending legs 42, 44 and 46. Leg 42 is positioned at the free edge of second base portion 36 and presents a continuous barrier wall which extends upward from a floor surface to the upper surface 38 of base portion 36. Leg 46 is likewise positioned at the free edge of the first base portion 32 to form a continuous barrier wall along the edge thereof. Legs 42 and 46 thus serve not only to elevate and support the base upper surfaces 34 and 38 at the desired height, but also reduce air and moisture infiltration under the threshold 16. Intermediate leg 44 is positioned at the junction between the base portions 32 and 36 to provide added support to the base 28. The base 28 can be mounted to the hinge and strike jambs 18 and 20 by threading screws (not shown) through the jambs and into suitable screw anchors 47 which are extruded into the base.

The riser 30 may be formed of various suitably durable materials, preferably those that are at least somewhat flexible and resilient. Examples of suitable materials include vinyl and other polymers and copolymers, including synthetic rubbers. The riser 30 has a top surface 48 which may optionally include parallel traction ribs 50. The riser 30 is supported on the base first portion 32 in a manner such that the top surface 48 of the riser extends at an angle to the horizontal. A plurality of longitudinally extending supports 52 extend from an undersurface of the riser 30 and contact the upper surface 34 of the underlying base portion 32 to maintain the riser 30 in the desired sloping orientation.

Turning additionally to FIG. 5, the riser 30 is releasably connected to the base 28 by suitable interlocking members which, in the illustrated embodiment, comprise longitudinally extending channels 54 and 56 formed at the front and back edges of the base first portion 32 and splines 58 and 60 carried by the riser 30 and sized to be tightly received in the corresponding channels 54 and 56 of the base. The splines 58 and 60 preferably include upwardly angled flanges 62 which contact the side walls of the channels 54 and 56. Due to their upward inclination, the flanges 62 are readily deformed during insertion of the splines 58 and 60 into the channels 54 and 56, but the flanges resist deformation during removal of the splines from the channels. The flanges 62 thus act to resist removal of the riser 30 from the base 28 once the splines have been inserted into the channels.

To prevent air or water infiltration into the channels 54 and 56, the riser 30 is of a sufficient width to extend over and slightly beyond the channels. The overhanging portions of the riser 30 present shoulders 64 that extend outwardly from the associated splines 58 and 60 at positions to contact and seal against the upper edge of the outer walls which form part of each channel 54 and 56. The channels 54 and 56 and splines 58 and 60 preferably extend the length of the threshold 16 in order to provide a continuous seal to prevent air or moisture from infiltrating between the riser 30 and the base 28. Additional insulation is provided by the flanges 62 contacting and sealing against the walls of the channels 54 and 56, and by the supports 52 contacting the upper surface 34 of the base first portion 32.

Turning now to FIG. 3, it can be seen that when the door 12 is mounted in the illustrated in-swing configuration, the threshold 16 can be oriented with the riser 30 positioned under the closed door 12 and with the top surface 48 of the riser 30 sloping downwardly toward the second base portion 36. In this configuration, the riser 30 serves to seal against the bottom of the door 12 to prevent air or water from seeping between the threshold 16 and the door 12. The door 12 may optionally include conventional bottom sealing elements such as a pair of vinyl tube-shaped sweeps 66 and a fin 68 to further enhance the seal between the door and the threshold 16. In the in-sweep configuration shown in FIG. 3, the sloping top surface 48 of the riser 30 ensures that any rainwater which drips from the door 12 onto the threshold 16 is directed onto the second base portion 36 and away from the interior of the building.

When it is desired to use the threshold 16 in conjunction with the door 12 mounted in an out-swing configuration as shown in FIG. 4, the threshold 16 can be left in place and rotated 180° with the door frame 14 from the position shown in FIG. 3. The riser 30 is then simply removed from the base 28 and rotated 180° to its original orientation with the top surface 48 sloping downwardly in the direction of opening of the door 12. The placement of the interconnecting channels 54 and 56 and splines 58 and 60 allow the riser 30 to then be reconnected to the base 28 and provide the desired seal against the bottom of the door 12. The reversibility of the riser 30 is particularly important in this regard as it allows the downward slope of the riser top surface 48 to always be directed toward the outdoors to ensure that water is unable to seep under the door 12 and into the building. It will be appreciated that the threshold 16 can also be rotated independently of the other components of the door frame 14, such as for those applications where it is necessary to move only the door 12 and the threshold 16 to change the direction of opening of the door 12.

The construction of threshold 16 allows it to be readily adapted for use in conjunction with both an in-swing and an out-swing door assembly 10 by simply placing the base 28 in the desired orientation and attaching the riser 30 to the base with the top surface 48 sloping in the proper direction. This versatility allows a single threshold 16 to be used in either type of door assembly and eliminates the need for thresholds dedicated for use with only one type of door assembly. Notably, threshold 16 is quickly adaptable for use with both in-swing and out-swing assemblies despite the fact that it extends completely from the front to the back edges of the frame jambs 18 and 20 and the riser 30 has a sloping top surface 48.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A threshold comprising:

a base;

a riser coupled with the base and having a top surface which extends in a plane at an angle to a horizontal plane; and interlocking members carried by the base and the riser for allowing the riser to be removably connected to the base in a first position with the top surface of the riser tilted in one direction in relation to a reference orientation of the base, said riser and interlocking members being constructed in a manner to permit the riser to be detached from the base and then reconnected to the base in a second position rotated from the first position with the top surface tilted in an opposite direction in relation to the reference orientation of the base.

2. The threshold as set forth in claim 1, wherein said interlocking members comprise a first channel and a first member releasably insertable within the channel.

3. The threshold as set forth in claim 2, wherein said first member comprises a spline having outwardly and upwardly extending flanges.

4. The threshold as set forth in claim 2, wherein said first channel is formed in said base and said first member is integral with the riser.

5. The threshold as set forth in claim 4, wherein said first channel extends substantially the length of the threshold.

6. The threshold as set forth in claim 5, wherein said interlocking members include a second channel and a second member spaced from said first channel and said first member.

7. The threshold as set forth in claim 6, wherein said first and second member each comprises a spline having outwardly extending flanges.

8. The threshold as set forth in claim 7, wherein said base includes means mounted on opposite ends of the base for coupling the base with a door hinge jamb and a door strike jamb.

9. The threshold as set forth in claim 7, wherein said base includes a first portion underlying said riser and a second portion extending outwardly from the first portion.

10. A door and frame assembly comprising:

a hinge jamb;

a strike jamb spaced from the hinge jamb to provide a doorway opening;

a head connecting upper portions of the hinge jamb and the strike jamb;

a door mounted to the hinge jamb for swinging movement between an open position and a closed position;

a threshold extending between lower portions of the hinge jamb and the strike jamb, said threshold comprising a base, a riser coupled with the base and having a top surface which extends in a plane at an angle to a horizontal plane, and interlocking members carried by the base and the riser for allowing the riser to be removably connected to the base in a first position with the top surface of the riser tilted in one direction in relation to a reference orientation of the base, said riser and interlocking members being constructed in a manner to permit the riser to be detached from the base and then reconnected to the base in a second position rotated from the first position with the top surface tilted in an opposite direction in relation to the reference orientation of the base, said top surface of the riser being positioned to underlie and sealingly engage a bottom portion of the door when the door is in the closed position.

11. The door and frame assembly as set forth in claim 10, wherein said interlocking members comprise a first channel and a first member releasably insertable within the channel.

12. The door and frame assembly as set forth in claim 11, wherein said first member comprises a spline having outwardly extending flanges.

13. The door and frame assembly as set forth in claim 11, wherein said first channel is formed in said base and said first member is integral with the riser.

14. The door and frame assembly as set forth in claim 13, wherein said first channel extends substantially the length of the threshold.

15. The door and frame assembly as set forth in claim 14, wherein said interlocking members include a second channel and a second member spaced from said first channel and said first member.

16. The door and frame assembly as set forth in claim 15, wherein said first and second members each comprises a spline having outwardly and upwardly extending flanges.

17. The door and frame assembly as set forth in claim 16, wherein said base includes means mounted on opposite ends of the base for coupling the base with a door hinge jamb and a door strike jamb.

18. The door and frame assembly as set forth in claim 16, wherein said base includes a first portion underlying said riser and a second portion extending outwardly from the first portion.

19. The door and frame assembly as set forth in claim 18, wherein said base is constructed to be reversibly positioned with the second portion of the base extending away from the direction of opening of a door when it is mounted on the door frame in a configuration for opening inwardly and when it is mounted on the door frame in a configuration for opening outwardly.

20. A threshold comprising:

a base having a first portion and a second portion, said second portion extending outwardly from the first portion, said base being constructed to be reversibly positioned in a door frame with the second portion of the base extending away from the direction of opening of a door when the door is mounted on the frame for inward opening and when the door is mounted on the frame for outward opening;

a riser coupled with the base in a position overlying the first portion of the base and having a top surface which extends in a plane at an angle to a horizontal plane; and interlocking members carried by the base and the riser for allowing the riser to be removably connected to the base in a first position with the top surface of the riser tilted in one direction in relation to a reference orientation of the base, said riser and interlocking members being constructed in a manner to permit the riser to be detached from the base and then reconnected to the base in a second position rotated from the first position with the top surface tilted in an opposite direction in relation to the reference orientation of the base, said interlocking members comprising spaced apart channels and spaced apart splines constructed for removable insertion within the channels, said splines having outwardly and upwardly extending flanges positioned for contacting portions of the channels for resisting removal of the splines after insertion into the channels.

* * * * *